United States Patent [19]

Huang

[11] Patent Number: 4,747,031

[45] Date of Patent: May 24, 1988

[54] ASSEMBLED LAMPSHADE

[76] Inventor: Mycoh Huang, Fl. 4 84 Min Chin Street, Yungho, Taipei Hsien, Taiwan

[21] Appl. No.: 71,298

[22] Filed: Jul. 9, 1987

Related U.S. Application Data

[63] Continuation-in-part of Ser. No. 940,338, Dec. 11, 1986, Pat. No. 4,688,155.

[51] Int. Cl.[4] ..... F21V 1/06

[52] U.S. Cl. ..... 362/352; 362/358; 362/360

[58] Field of Search ..... 362/352, 358, 360, 351

[56] References Cited

U.S. PATENT DOCUMENTS 1,863,767 6/1932 Shapiro ..... 362/358

2,435,759 2/1948 Spaw ..... 362/358

*Primary Examiner*—E. Rollins Cross

[57] ABSTRACT

This invention discloses an assembled lampshade which includes a sector shade, a plurality of spiral connectors connected to the edges of the sector shade, and a plurality of supporting members connected to the sector shade and spiral connectors to construct a firmly assembled lampshade. During transport and storage of this lampshade, all of the supporting members can be disassembled and the sector shade with the spiral connectors secured thereto can be flattened as a result of their flexibility. Therefore, the space occupied by the lampshade is significantly reduced. When necessary, the lampshade can be readily re-assembled without any special skills.

3 Claims, 4 Drawing Sheets

ASSEMBLED LAMPSHADE

BACKGROUND OF THE INVENTION

This is a continuation-in-part of U.S. patent application Ser. No. 940,338, filed Dec. 11, 1986, now U.S. Pat. No. 4,688,155.

This invention relates to a lampshade, and more particularly to an improved lampshade which can be disassembled for easier transport and storage, and be readily re-assembled by the user later.

Conventional lampshades for table lamps have fixed shapes, for example, the frustum of a cone. Their frames are integral and not detachable. They have some inherent drawbacks, for example, since the finished conventional lampshades are bulky and inflexible, they occupy large spaces during transport or storage resulting in more cost. Conventional lampshades also are rather susceptible to damage and/or deformation during transport. If the lampshade is damaged, the whole table lamp must be thrown away, even though the lamp itself is still intact. Another drawback is that a user may tire of a certain color or pattern of lampshade after a long period of use. It is impossible, however, to only substitute a new lampshade for the old one without buying a complete table lamp.

An assembled lampshade according to one preferred embodiment of this invention eliminates the above problems.

SUMMARY OF THE INVENTION

One object of this invention is to provide an assembled lampshade which can be readily disassembled to occupy a smaller space during transport or storage, so that its packing, transport and storage costs are greatly reduced. The lampshade can also be easily re-assembled by the user later.

Another object of this invention is to provide an assembled lampshade which comprises a sector shade, a top ring, a bottom ring, and optionally, a lateral rib. The sector shade can be solely replaced to form a new lampshade or a lampshade of a new color, pattern and/or style. This replacement does not affect the intact structure of the lampshade or the lamp stand.

In accordance with a preferred embodiment of this invention, an assembled lampshade comprises a sector shade, having four arrays of apertures provided near its top, bottom and two side edges, respectively; a top spiral connector connected to the top edge of the sector shade through the array of apertures provided near the top edge of the sector shade; a bottom spiral connector connected to the bottom edge of the sector shade through the array of apertures provided near the bottom edge of the sector shade; a side spiral connector, connecting the two side edges of the sector shade together through the two arrays of apertures provided near the side edges of the sector shade; an open-ended top ring inserted through the top spiral connector with its two ends detachably engaged with each other to form a closed ring; an open-ended bottom ring inserted through the bottom spiral connector with its two ends opposite each other; a lateral rib, inserted through the side spiral connector, and detachably engaged with the top ring at one end and with the opposite ends of the bottom ring at its other end so that the opposite ends of the bottom ring are detachably engaged with each other through the rib to form a closed ring; and a mounting member adapted to mount the sector shade onto a lamp stand, and having two ends detachably connected to the top ring.

BRIEF DESCRIPTION OF THE DRAWINGS

This invention will be more fully understood from the following detailed description, taken in connection with the accompanying drawings which form an integral part of this application and in which.

DETAILED DESCRIPTION OF THE PREFERRED EMBODIMENT

Figure 1:
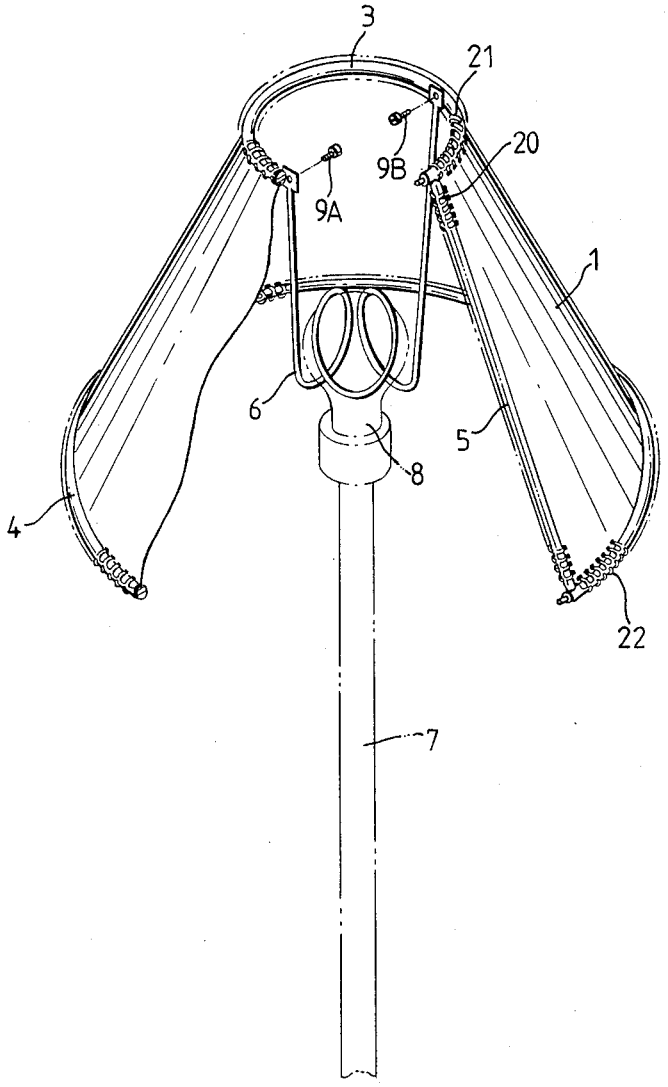
FIG. 1 is a perspective view of an assembled lampshade according to a preferred embodiment of this invention, with part broken away to show the lampshade being mounted on a lamp bulb which is secured to the top of a lamp stand.
Figure 3:
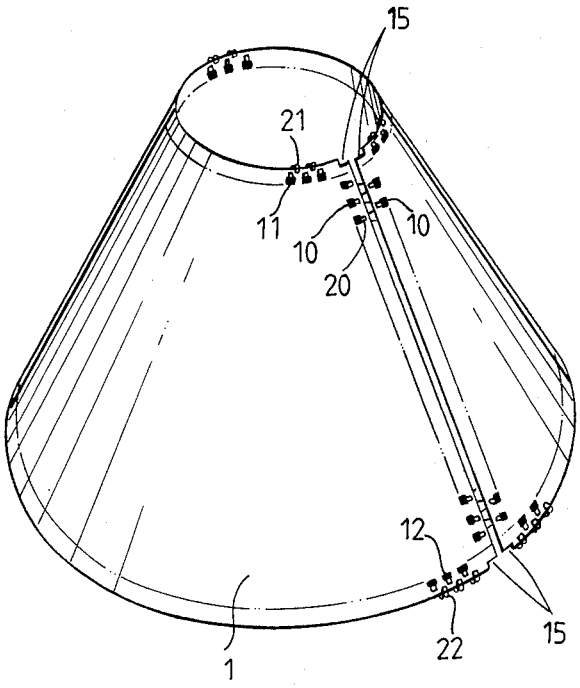
FIG. 3 is a perspective view showing how the two side edges of the sector shade are connected to each other by the side spiral connector according to the same preferred embodiment of this invention.
Figure 4:
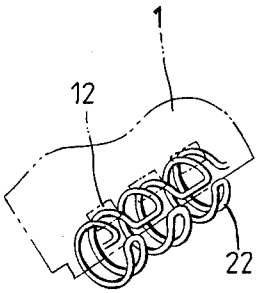
FIG. 4 is a enlarged fragmentary view of the sector shade as shown in FIGS. 1 and 3, clearly illustrating the spiral connectors according to the same preferred embodiment of this invention.

Referring now to the drawings, it should be noted that a like member is designated with a like reference number. FIG. 3 shows a sector shade 1 in an expanded position. The sector shade 1 has four arrays of apertures 10, 10, 11 and 12 provided near its two side, top and bottom edges, respectively. The shade 1 is formed of a flexible material, such as polyvinyl chloride (PVC). A top spiral connector 21 is engaged into the array of apertures 11 and thus connected to the top edge of the sector shade 1. The term "spiral connector" described herein implies a connector which has a structure similar to those being used in spiral notebooks, and the like. This enables the sector shade to rotate 360 degrees about the spiral connector. The structure of the spiral connector as shown in FIGS. 1, 3 and 4 illustrates only one preferred form of the spiral connector. Other similar structures, however, such as a spiral connector of the helical spring type, are also applicable to this invention.

Similarly, a bottom spiral connector 22 is engaged into the array of apertures 12 and thus connected to the bottom edge of the sector shade 1. A side spiral connector 20 is engaged into the adjacent two arrays of apertures 10 and 10 to connect the two side edges of the sector shade 1 together. As best seen in FIGS. 1 and 3, the sector shade 1 can be expanded to form the shape of a frustum of a cone. When the sector shade 1 is not in use, it can be flattened due to its flexibility.

Figure 2:
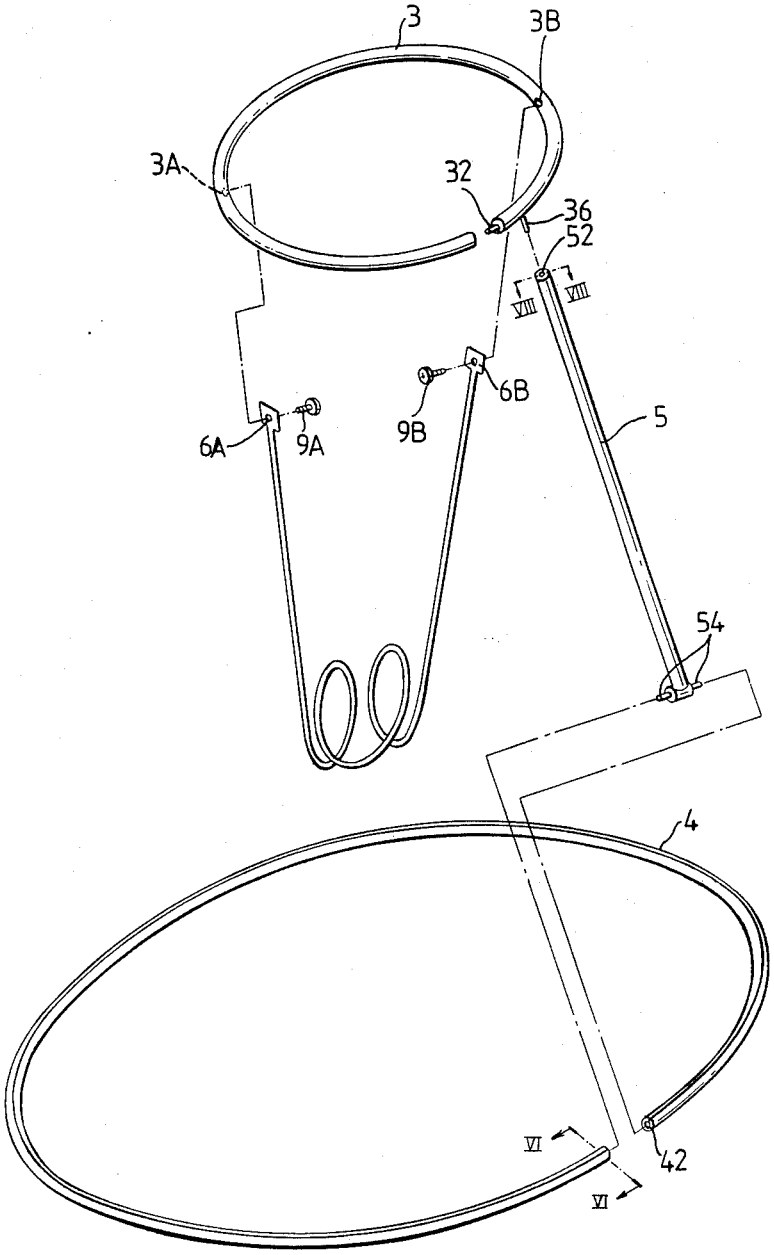
FIG. 2 is an exploded perspective view of the supporting members for the sector shade according to the same preferred embodiment of this invention.

With reference to FIGS. 1 and 2, the supporting structure for the lampshade includes a top ring 3, a bottom ring 4, a lateral rib 5 and a mounting member 6. The top ring 3 forms a nearly whole circular shape, and has a projection 32 at its one end and a recess 34 (see also FIG. 5) at the other end. When being assembled, the top ring 3 is inserted through the top spiral connector 21 and connected at its two ends via the engagement between the projection 32 and the recess 34. Thus the top edge of the sector shade 1 is curved by the top ring 3 to form a circular appearance. The bottom ring 4 also forms a nearly whole circular shape having a diameter larger than that of the top ring 3, and has a recess 42 at each of its ends. When being assembled, the bottom ring 4 is inserted through the bottom spiral connectors 23 to curve the bottom edge 15 of the sector shade 1 into a circular shape, whereby the ends of the bottom ring 4 are opposite each other, as shown in FIG. 2.

Figure 8:
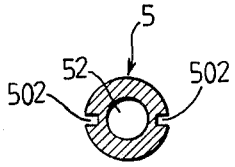
FIG. 8 is an enlarged cross-sectional view of the lateral rib taken along a line VIII—VIII in FIG. 2.

The lateral rib 5 has a recess 52 in its upper end, as best seen in FIG. 8, and two projections 54 near its lower end, which extend in circumferentially opposite directions and are perpendicular to the longitudinal direction of the rib 5. The top ring 3 also has a protuberance 36 near its one end. When being assembled, the lateral rib 5 is inserted through the side spiral connector 30 with its recess 52 in the upper end engaged with the protuberance 36 of the top ring 3. Then the recesses 42 provided at the opposite ends of the bottom ring 4 are engaged with the projections 54 of the lateral rib 5, whereby, a firm lampshade appearance is obtained.

Figure 5:
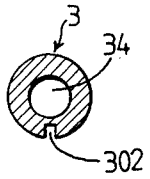
FIG. 5 is an enlarged cross-sectional view of the top ring of this invention, taken along a line V—V in FIG. 2.
Figure 6:
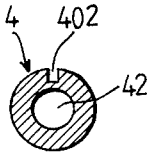
FIG. 6 is an enlarged cross-sectional view of the bottom ring of this invention, taken along a line VI—VI in FIG. 2.
Figure 7:
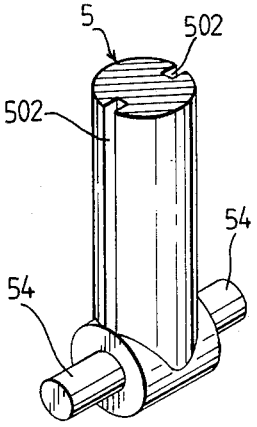
FIG. 7 is an enlarged fragmentary perspective view of the lateral rib shown in FIG. 2 of this invention.

The top ring 3 may have a lower groove 302, as shown in FIG. 5, extending along its longitudinal length for engaging the top edge of the sector shade 1. Similarly, the bottom ring 4 may have an upper groove 402, as best seen in FIG. 6, extending along its longitudinal length for engaging the bottom edge of the sector shade 1; the lateral rib 5 may have two side grooves 502 to each other, as shown in FIGS. 7 and 8, extending along its longitudinal length for engaging the two adjacent side edges of the sector shade 1. By use of the grooves 302, 402 and 502, the edges of the sector shade are arranged in fixed positions. In order to prevent the sector shade from sliding along the grooves after the lampshade is assembled, each of the corners of the sector shade is provided with a cutout 11, as shown in FIG. 4, and each of the grooves 302, 402 and 502, which do not extend through the entire lengths of the top and bottom rings 3, 4 and the lateral rib 5, has left at each end a remaining portion for stopping the cutout 11, the lengths of the grooves are approximately equal to the lengths of the corresponding edges of the sector shade.

It should be understood that in order to facilitate the assembly of this lampshade, the top and bottom rings 3, 4 and the lateral rib 5 may be formed of a material having a slight flexibility.

The mounting member 6, as shown in FIGS. 1 and 3, has two upper ends 6A and 6B fastened, e.g. by two set screws 9A and 9B, to two diametrically opposite locations 3A and 3B on the top ring 3, and has a mounting zone at its lower portion for mounting onto a lamp bulb 8 which is secured to the top of a lamp stand 7. It should be noted that other types of mounting member can also be used. This is obvious to those who are ordinarily skilled in the art.

During transport and storage of the lampshade of this invention, all of the supporting members including the top ring, the bottom ring, the lateral rib and the mounting member are disassembled, and the sector shade is flattened thanks to its flexibility. The space occupied by the lampshade is thus greatly reduced, resulting in a significant decrease in packing, storage and transport costs. When one desires to use the lampshade, it can be readily reassembled without any special skills.

According to the above preferred embodiment of this invention, a lateral rib is provided between the adjacent two side edges of the sector shade and inserted through the side spiral connector. However, this lateral rib may also be omitted.

While the invention has been described in connection with what is presently considered to be the most practical and preferred embodiment, it is to be understood that the invention is not to be limited to the disclosed embodiment but, on the contrary, is intended to cover various modifications and equivalent arrangements included within the spirit and scope of the appended claims which scope is to be accorded the broadest interpretation so as to encompass all such modifications and equivalent structures.

What is claimed is:

1. An assembled lampshade comprising:
- a sector shade, having four arrays of apertures near its top, bottom and two side edges;
- a top spiral connector connected to the top edge of said sector shade, through said array of apertures provided near the top edge of said sector shade;
- a bottom spiral connector connected to the bottom edge of said sector shade, through said array of apertures provided near the bottom edge of said sector shade;
- a side spiral connector, connecting the two side eages of said sector shade together through said two arrays of apertures provided near the two side edges of said sector shade;
- an open-ended top ring inserted through said top spiral connector with its two ends detachably engaged to form a closed ring;
- an open-ended bottom ring inserted through said bottom spiral connector with its two ends opposite each other;
- a lateral rib inserted through said side spiral connector, and detachably engaged with said top ring at its one end and with said two opposite ends of said bottom ring at its other end so that said two opposite ends of said bottom ring are detachably engaged with each other through said lateral rib; and
- a mounting member adapted to mount said sector shade to a lamp shade, and having two ends detachably connected to said top ring.

2. An assembled lampshade as claimed in claim 1, wherein said top ring has a lower groove along its length for engaging the top edge of said sector shade; said bottom ring has an upper groove along its length for engaging the bottom edge of said sector shade; and said lateral rib has two side grooves along its length for engaging said two opposite side edges of said sector shade.

3. An assembled lampshade, comprising:
- a sector shade, having four arrays of apertures near its top, bottom and two side edges;
- a top spiral connector connected to the top edge of said sector shade, through said array of apertures provided near the top edge of said sector shade;
- a bottom spiral connector connected to the bottom edge of said sector shade, through said array of apertures provided near the bottom edge of said sector shade;
- a side spiral connector, connecting the two side eages of said sector shade together through said two arrays of apertures provided near the two side edges of said sector shade;

an open-ended top ring inserted through said top spiral connector with its two ends detachably engaged to form a closed ring, said top ring has a lower groove along its length for engaging the top edge of said sector shade;

an open-ended bottom ring inserted through said bottom spiral connector with its two ends detachably engaged to form a closed ring, said bottom ring has an upper groove along its length for engaging the bottom edge of said sector shade;

a mounting member adapted to mount said sector shade to a lamp stand, and having two ends detachably connected to said top ring.

* * * * *